US012467343B1

(12) United States Patent
Ma et al.

(10) Patent No.: US 12,467,343 B1
(45) Date of Patent: Nov. 11, 2025

(54) INTEGRATED SELECTIVE-FIRING DETONATOR SPECIAL FOR OIL AND GAS WELLS

(71) Applicant: CHENGDU ROCK PETROLEUM CO., LTD, Sichuan (CN)

(72) Inventors: Tianming Ma, Sichuan (CN); Wanmeng Ren, Sichuan (CN); Zhengxu Zhang, Sichuan (CN)

(73) Assignee: CHENGDU ROCK PETROLEUM CO., LTD, Chengdu (CN)

( * ) Notice: Subject to any disclaimer, the term of this patent is extended or adjusted under 35 U.S.C. 154(b) by 0 days.

(21) Appl. No.: 19/219,449

(22) Filed: May 27, 2025

(30) Foreign Application Priority Data

Sep. 14, 2024 (CN) ..... 202411289168.9

(51) Int. Cl.
*E21B 43/1185* (2006.01)

(52) U.S. Cl.
CPC ..... *E21B 43/1185* (2013.01)

(58) Field of Classification Search
CPC .. E21B 43/1185; E21B 43/119; E21B 43/117; E21B 43/11857; F42D 1/05; F42D 1/045
See application file for complete search history.

(56) References Cited

U.S. PATENT DOCUMENTS 11,867,032 B1 * 1/2024 Parks ..... E21B 43/117
12,270,284 B1 * 4/2025 Nemez ..... E21B 43/1185
2016/0333676 A1 11/2016 Hardesty
2019/0212118 A1 7/2019 Saltarelli
2020/0284126 A1 9/2020 Mauldin
2024/0133275 A1 * 4/2024 Ghosh ..... E21B 43/117
2024/0352832 A1 * 10/2024 Sullivan ..... F16C 19/364
(Continued)

FOREIGN PATENT DOCUMENTS

CN 109763796 A 5/2019
CN 114753810 A 7/2022
CN 116658133 A 8/2023
(Continued)

OTHER PUBLICATIONS

Notification to Grant Patent Right for Invention, Chinese Application No. 202411289168.9, mailed Nov. 7, 2025 (3 pages).
(Continued)

*Primary Examiner* — Daniel P Stephenson
(74) *Attorney, Agent, or Firm* — HOWARD M COHN and Associates, LLC

(57) ABSTRACT

The invention discloses an integrated selective-firing detonator special for oil and gas wells, including an integrated selective-firing detonator body and a detonation transmission device for receiving and transmitting external detonation signals to control selective firing of perforating bullets. The integration of the detonation transmission device, the selective-firing detonator body, and grounding protection components reduces assembly procedures and improves system integrity and reliability. The cooperation between a control mechanism and a selective-detonation mechanism significantly enhances the reliability of the product. Meanwhile, a grounding nut and a high-temperature shell improve electrical safety. The compact structure simplifies operation and improves working efficiency.

1 Claim, 9 Drawing Sheets

(56) References Cited

U.S. PATENT DOCUMENTS

2024/0352834 A1* 10/2024 Sullivan ..... E21B 43/119

FOREIGN PATENT DOCUMENTS

| | | | |
|---|---|---|---|
| CN | 116877032 | A | 10/2023 |
| CN | 117703319 | A | 3/2024 |
| CN | 117888864 | A | 4/2024 |
| WO | 2021191275 | A1 | 9/2021 |

OTHER PUBLICATIONS

CNIPA, Office Action issued for Chinese Application No. 202411289168.9, mailed Oct. 25, 2025 (17 pages).

"Handbook of New Technologies and Standardspecifications for the Petroleum Industry", Shengzhong Hu et al., pp. 1283-1293, Harbin: Harbin Map Publishing House, 1st Edition, Publication date on Mar. 31, 2004.

* cited by examiner

INTEGRATED SELECTIVE-FIRING DETONATOR SPECIAL FOR OIL AND GAS WELLS

BACKGROUND OF THE INVENTION

1. Technical Field

The invention relates to the technical field of perforation of oil and gas wells, in particular to an integrated selective-firing detonator specifical for oil and gas wells.

2. Description of Related Art

An integrated selective-firing detonator special for oil and gas wells is an important component in completion of oil and gas wells and is mainly used for controlling the time and sequence of underground perforation. During perforation of oil and gas wells, a detonator is used for detonating perforating bullets to realize perforation of a hydrocarbon reservoir, and the use of an integrated selective-firing detonator may significantly improve perforation efficiency and safety, reduce necessary underground operations and optimize the output of oil and gas wells.

At present, a selective-firing switch and a large-resistance detonator are connected directly by means of a wire when used in the site. Such a connection method not only may increase the potential risk of erroneous wiring of users, but also may reduce the working efficiency in the site of oil and gas wells and increase the risk of accidental detonation due to mis-operation; and an output port of the selective-firing switch is led out by means of a wire and is generally welded manually, which not only reduces the production efficiency of the selective-firing switch, but also limits the degree of automation of the production process.

BRIEF SUMMARY OF THE INVENTION

To solve the problems in the prior art, the invention provides an integrated selective-firing detonator special for oil and gas wells to improve production efficiency and lower the risk of accidental detonation.

To fulfill the above object, the invention is implemented by the following technical solution:

An integrated selective-firing detonator special for oil and gas wells includes an integrated selective-firing detonator body, and the integrated selective-firing detonator body is used for controlling the time and condition of an explosion, thus improving the reliability and safety of the detonator and facilitating operation and management; a detonation transmission device is connected to an end of the integrated selective-firing detonator body, used for receiving an external detonation signal and transmitting the external detonation signal to the integrated selective-firing detonator body to control selective firing of perforating bullets, and also used for transmitting explosive energy produced by the detonator to a target explosive to realize detonation, thus ensuring that the explosive energy is accurately and efficiently transmitted to the explosive to fulfill an expected blasting effect; a grounding nut is connected to an end, away from the detonation transmission device, of the integrated selective-firing detonator body and used for guiding unsafe factors caused by abnormal current in the detonator to the ground; a positioning disc is mounted on an outer surface of the integrated selective-firing detonator body, a side surface, away from the grounding nut, of the positioning disc is fixed to an end of the detonation transmission device, and the positioning disc is used for securing the integrated selective-firing detonator body and fixing the position of the detonator in oil and gas wells to ensure that the detonator accurately points to the target explosive; and a plastic denotating member is mounted on the outer surface of the integrated selective-firing detonator body extending into the detonation transmission device and used for connecting the detonator and the explosive to transmit explosive energy;

wherein, the integrated selective-firing detonator body includes a shell, an outer surface of the shell is connected to an inner surface of the positioning disc, a selective-detonation mechanism is mounted on an inner wall of the shell, and a control mechanism is mounted at an end of the selective-detonation mechanism and used for controlling selective firing of the perforating bullets.

Preferably, the shell includes an upper shell body, a lower shell body is detachably mounted on a side of the upper shell body, the upper shell body and the lower shell body are clamped together, and outer surfaces of the upper shell body and the lower shell body away from the detonation transmission device are in threaded fit with an inner surface of the grounding nut. The upper shell body and the lower shell body form the external structure of the detonator to protect internal elements and fix positions of components.

Preferably, the selective-detonation mechanism incudes a selective-firing circuit board, and the selective-firing circuit board is used for receiving external instructions, processing signals and controlling the detonation time of the detonator to realize accurate detonation control of the detonator, thus improving operation safety and efficiency; and an outer surface of the selective-firing circuit board is adaptively clamped on the inner walls of the upper shell body and the lower shell body, a superior contact pin cap is connected to a side, away from the detonation transmission device, of the selective-firing circuit board, an outer surface of the superior contact pin cap is adaptively clamped on an inner wall of a contact surface between the upper shell body and the lower shell body, an internal circlip is arranged on an outer side of the superior contact pin cap, a side surface of the internal circlip is connected to end surfaces, away from the detonation transmission device, of the upper shell body and the lower shell body, and the internal circlip is used for fixing positions of the upper shell body and the lower shell body to prevent the upper shell body and the lower shell body from coming loose or being disconnected in the transportation and using process, thus guaranteeing the stability and reliability of the internal structure of the detonator.

Preferably, an end, close to the detonation transmission device, of the selective-firing circuit board extends out of the upper shell body and the lower shell body and fixedly connected to a detonator, an outer surface of the detonator is connected to an inner wall of the plastic detonating member, and the detonator, as a core component for producing explosive energy, is able to produce sufficient explosive energy to denotate a target explosive to realize perforation of oil and gas wells.

Preferably, subordinate conducting pogo pins are fixedly mounted on the outer surface of the selective-firing circuit board close to the detonator and used for transmitting an electric signal to ensure that the electric signal is accurately and quickly transmitted into the detonator to trigger an explosive reaction of the detonator; and the subordinate conducting pogo pins are symmetrically arranged with respect to a center line of the selective-firing circuit board, ends of the subordinate conducting pogo pins extend out of the upper shell body and the lower shell body, outer surfaces of the subordinate conducting pogo pins are connected to the inner walls of the upper shell body and the lower shell body, subordinate conducting plates are connected to the ends of the subordinate conducting pogo pins, outer surfaces of the subordinate conducting plates are fixed to the inner wall of the plastic detonating member, and the subordinate conducting plates, as one part of an internal circuit of the detonator, are used for transmitting the electric signal to the subordinate conducting pogo pins and a bridge-wire to ensure that the electric signal is accurately and quickly transmitted to key elements in the detonator to trigger the explosive reaction of the detonator.

Preferably, grounding pogo pins are fixedly mounted on the outer surface of the selective-firing circuit board and symmetrically arranged with respect to the center line of the selective-firing circuit board, and ends of the grounding pogo pins are connected to the inner walls of the upper shell body and the lower shell body.

Preferably, the control mechanism incudes a bridge-wire, the bridge-wire is fixedly mounted on an extension plate on sides, close to the detonation transmission device, of the subordinate conducting pogo pins and used for generating heat to trigger an explosion, and the detonator is disposed around the bridge-wire; and when receiving a sufficient electric signal, the bridge-wire, as a key element in the detonator, will generate heat quickly and trigger an explosion of an explosive, which in turn triggers detonation of the detonator, thus ensuring that the detonator may realize quick and accurate detonation after receiving an external signal.

Preferably, the inner surface of the positioning disc is connected to the outer surfaces of the upper shell body and the lower shell body, a bolt is threadedly connected to an outer surface of the positioning disc, and ends of the bolt extend into the positioning disc and are in contact with the outer surfaces of the upper shell body and the lower shell body to fasten the upper shell body and the lower shell body.

Preferably, the selective-firing circuit board includes a selective-firing control circuit, and the selective-firing control circuit and the bridge-wire are arranged on the same circuit board.

The invention has the following beneficial effects:

1. According to the integrated selective-firing detonator special for oil and gas wells, the detonation transmission device, the selective-firing detonator body and grounding protection components are highly integrated, such that connection and assembly processes between components are reduced, and the integrity and reliability of a system are improved; accurate selective-firing of perforating bullets is realized through the cooperation between the control mechanism and the selective-detonation mechanism, thus improving blasting accuracy and efficiency; the design of the grounding nut and the shell improves the electrical safety of the system; and the whole system is compact in structure and easy to operate, reduces the skill requirements for operators and improves working efficiency.

2. According to the integrated selective-firing detonator special for oil and gas wells, the upper shell body and the lower shell body are clamped to be preliminarily assembled together to form the enclosed shell, such that the shell may be assembled more easily; the end, away from the detonation transmission device, of the shell is adaptively connected to the inner surface of the grounding nut by threads, thus ensuring that the electrical grounding safety of the detonator system; moreover, the grounding nut further secures the upper shell body and the lower shell body; and the positioning disc is mounted outside the upper shell body and the lower shell body to provide stable positioning and support.

According to the integrated selective-firing detonator special for oil and gas wells, selective firing of perforating bullet is realized by control of the selective-firing circuit board, thus improving blasting accuracy and efficiency; the design of the grounding pogo pins and the grounding nut provide electrical protection to prevent an electrical accident; moreover, the stable shell structure and the sealing design improve the safety of the detonator, and the close fit between the bridge-wire and the detonator guarantees efficient transmission of detonation energy, thus improving the blasting effect.

Figure 1:
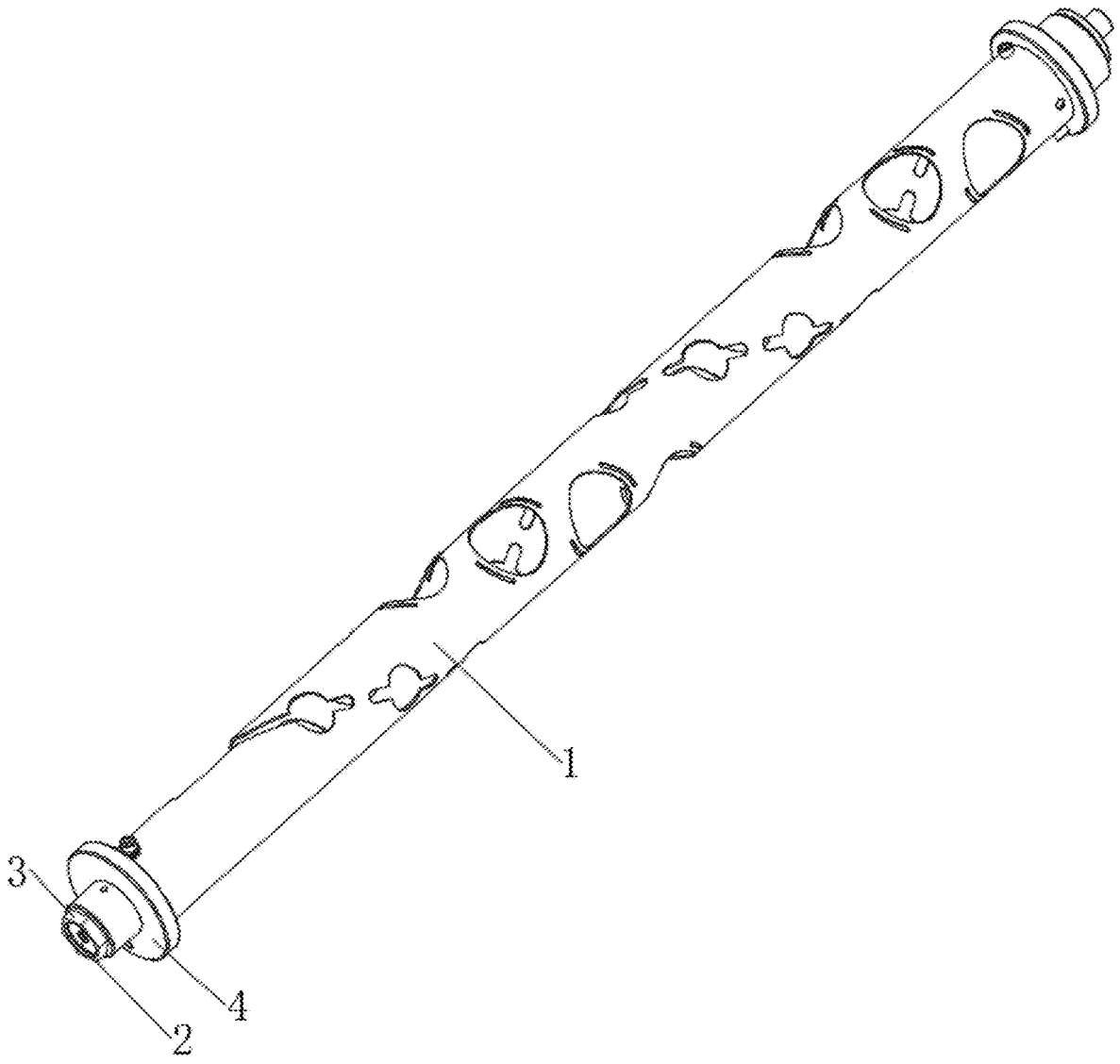
FIG. 1 is an external structural view of an integrated selective-firing detonator special for oil and gas wells according to the invention.
Figure 2:
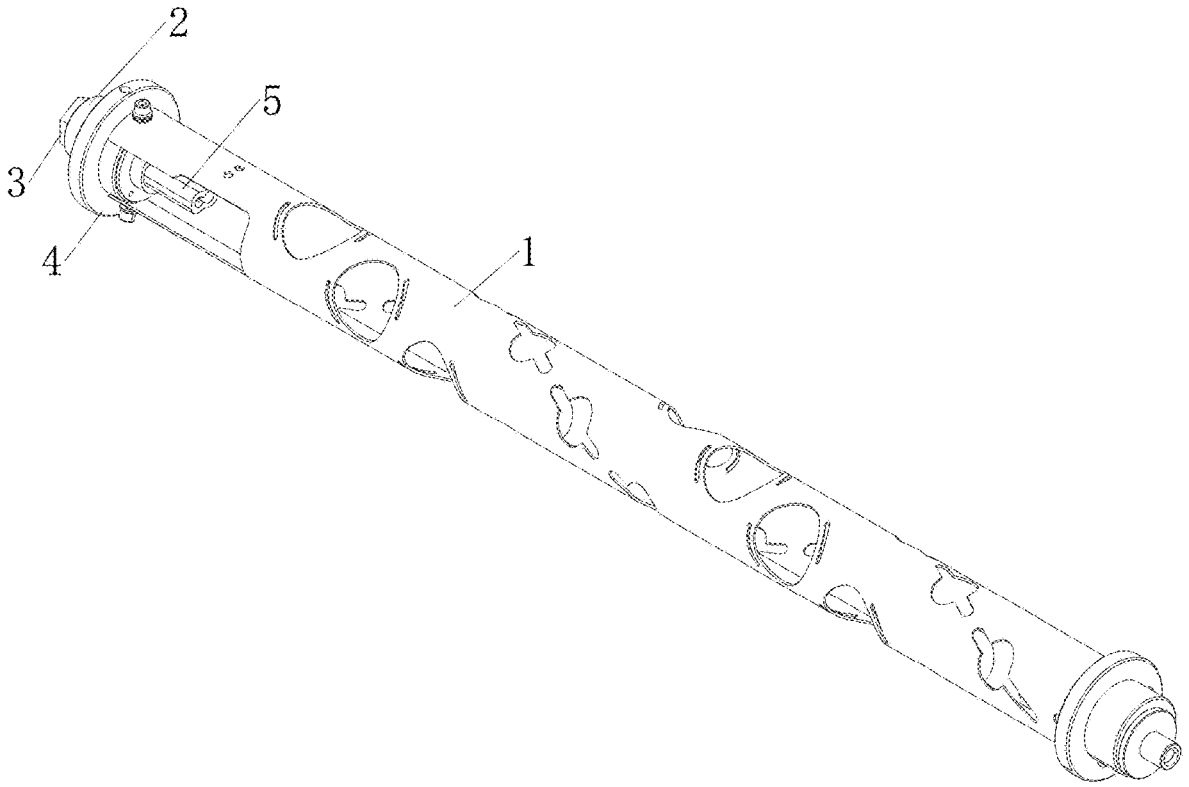
FIG. 2 is a structural stereogram according to the invention.
Figure 3:
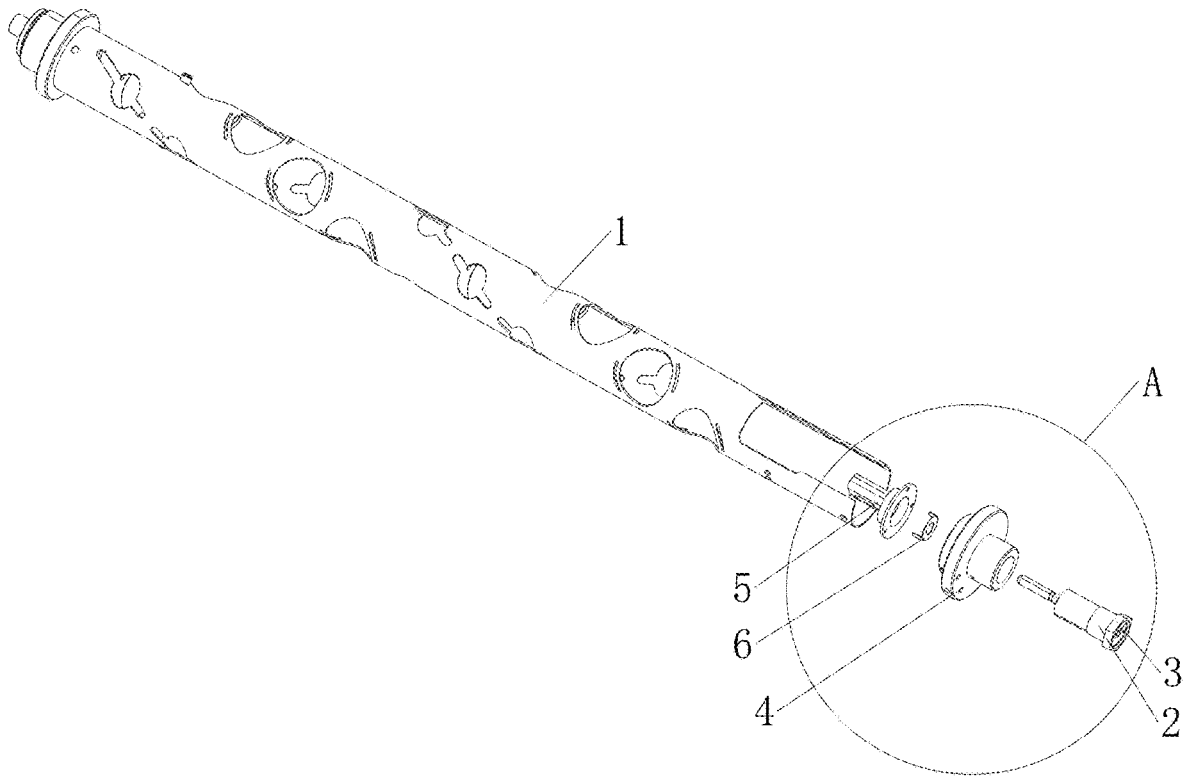
FIG. 3 is an exploded structural view according to the invention.
Figure 4:
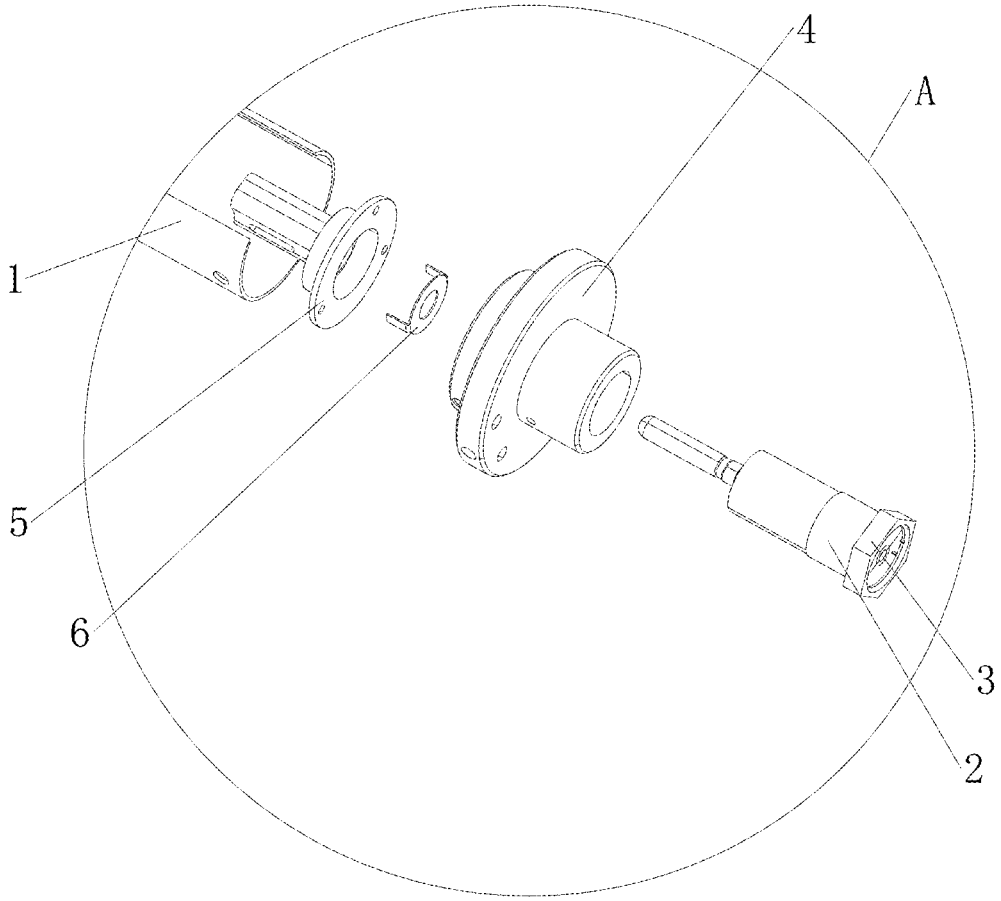
FIG. 4 is an enlarged structural view of part A in FIG. 3 according to the invention.
Figure 5:
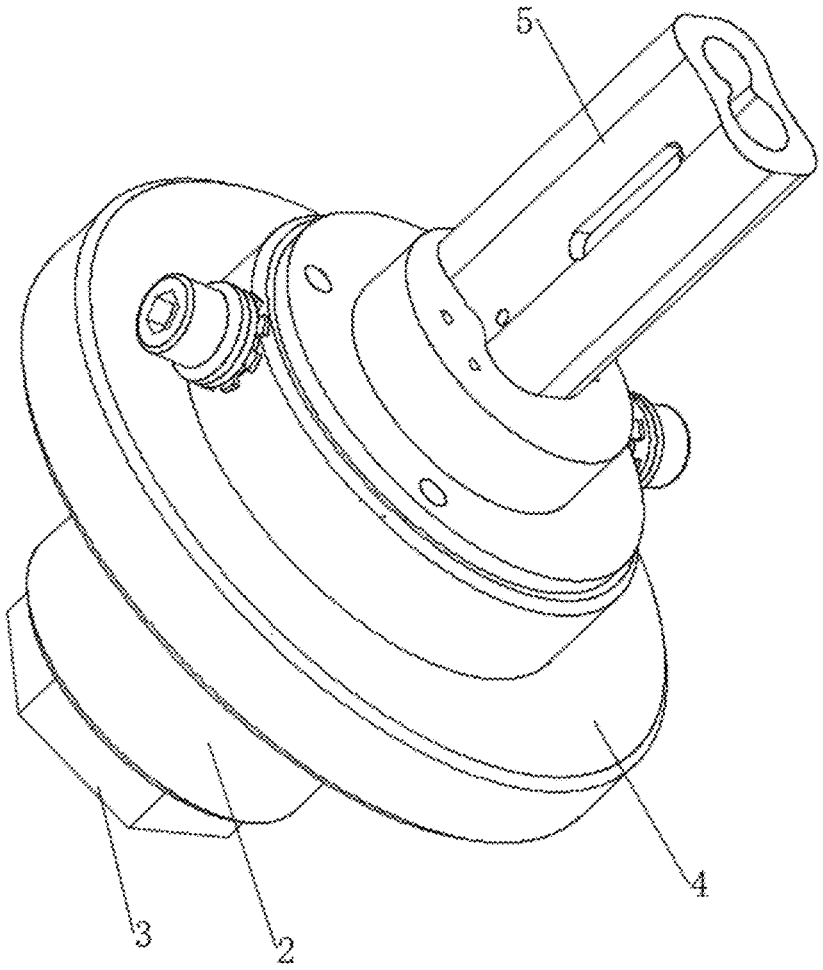
FIG. 5 is a partial structural view according to the invention.
Figure 6:
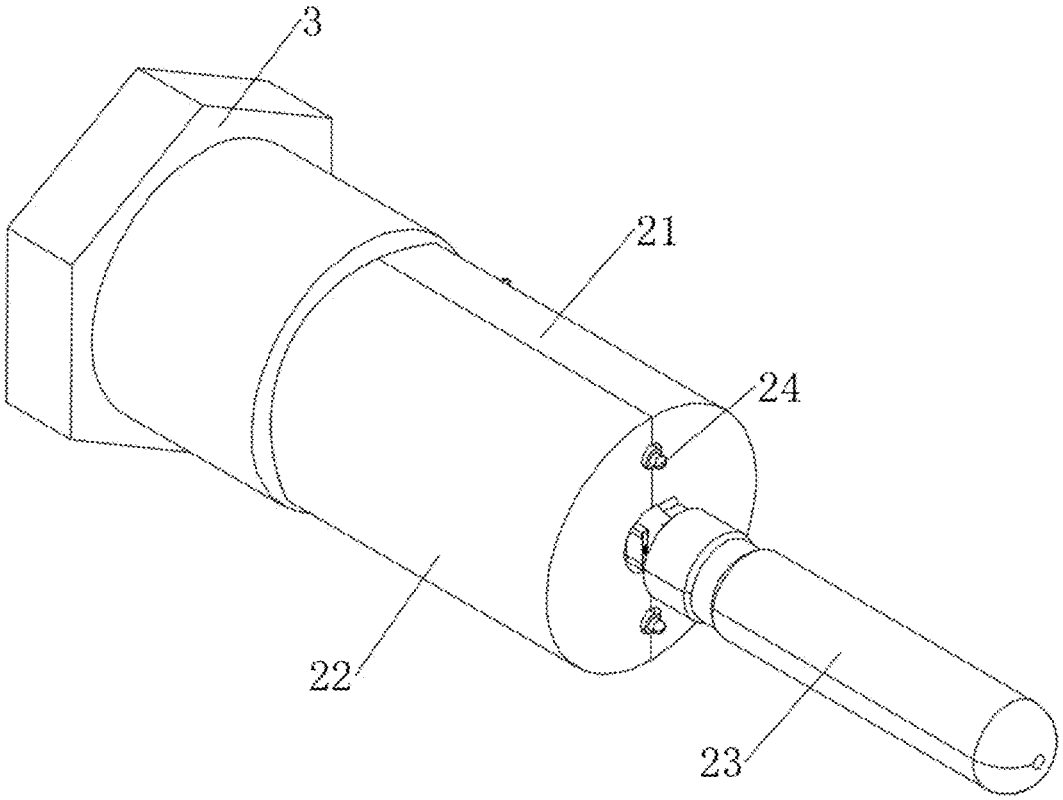
FIG. 6 is a structural stereogram of the integrated selective-firing detonator and a grounding nut according to the invention.
Figure 7:
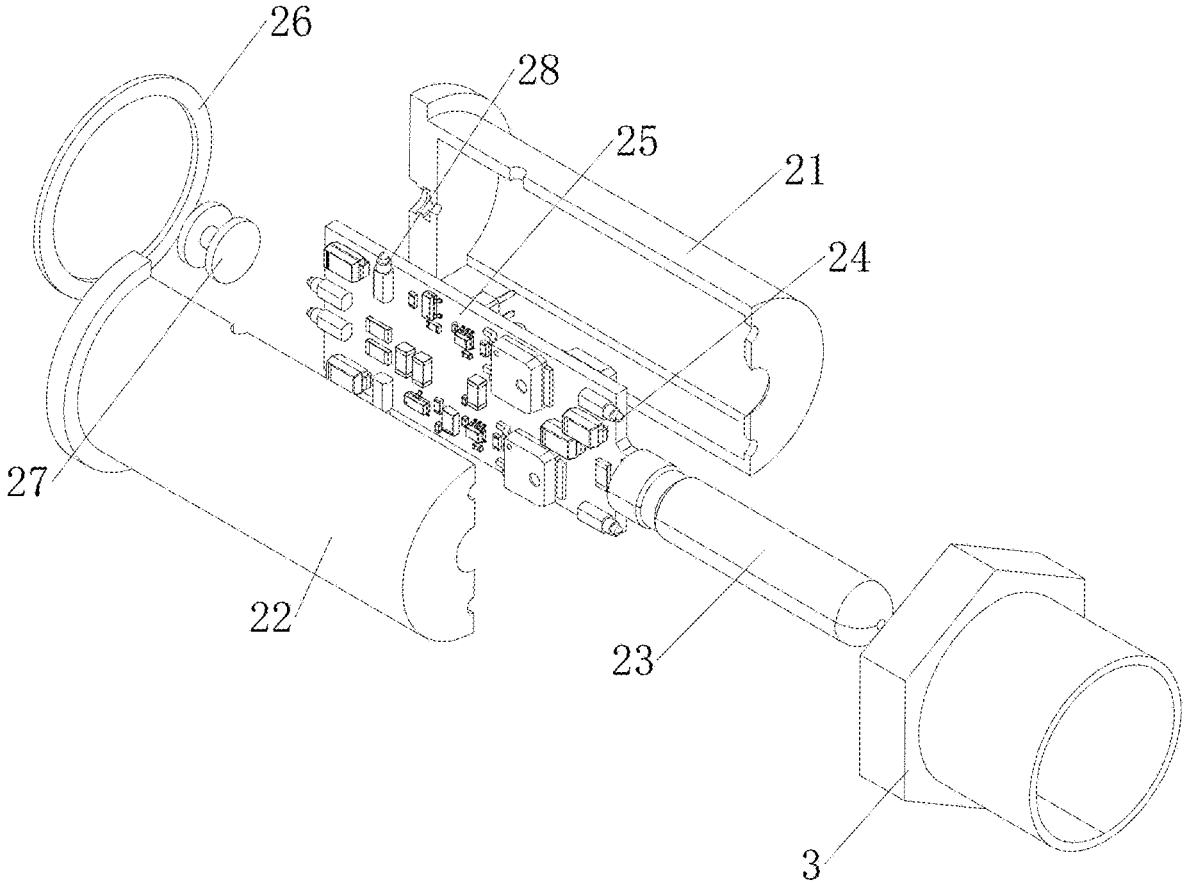
FIG. 7 is an exploded structural view of the integrated selective-firing detonator according to the invention.
Figure 8:
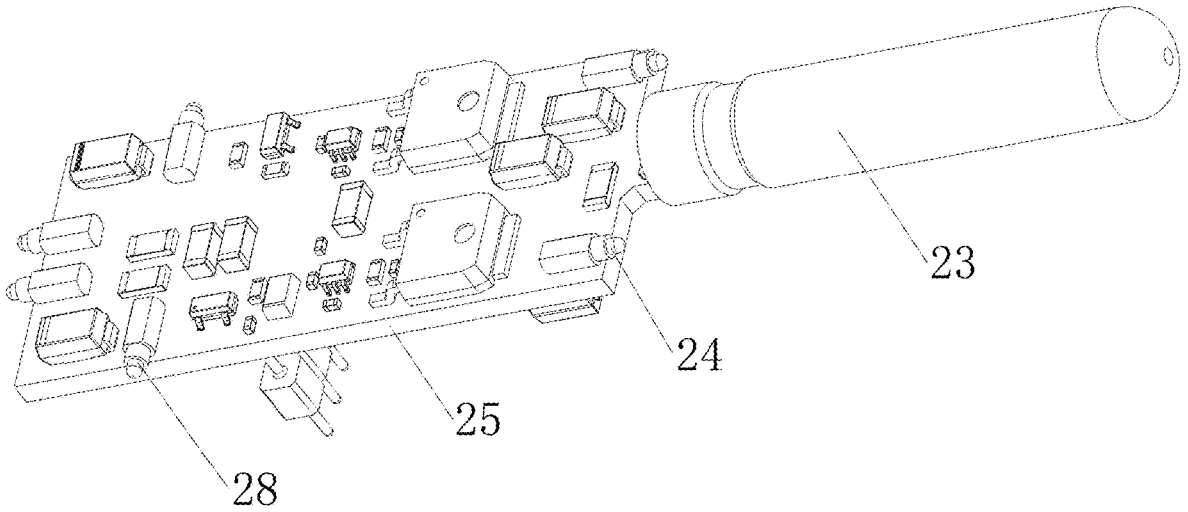
FIG. 8 is a structural stereogram of a detonator and a selective-firing circuit board according to the invention.
Figure 9:
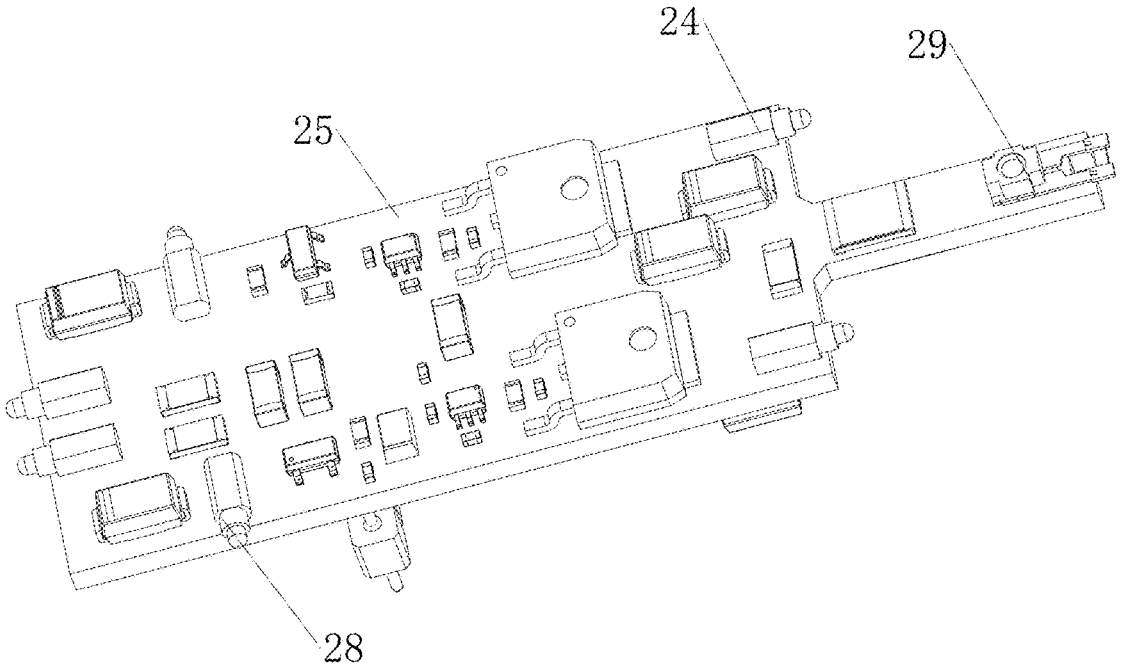
FIG. 9 is a structural stereogram of the selective-firing circuit board according to the invention.

In the FIGS.: 1, detonation transmission device; 2, integrated selective-firing detonator; 21, upper shell body; 22, lower shell body; 23, detonator; 24, subordinate conducting pogo pin; 25, selective-firing circuit board; 26, internal circlip; 27, superior contact pin cap; 28, grounding pogo pin; 29, bridge-wire; 3, grounding nut; 4, positioning disc; 5, plastic detonating member; 6, subordinate conducting plate.

DETAILED DESCRIPTION OF THE INVENTION

The invention is described in further detail below in conjunction with accompanying drawings and specific embodiments. The embodiments of the invention are provided for the purpose of illustration and description, and are not exhaustive or limit the invention to forms disclosed here. Many modifications and transformations are obvious for those ordinarily skilled in the art. The embodiments selected and described here are used to better explain the principle and practical application of the invention and allow those ordinarily skilled in the art to understand the invention to design various modified embodiments suitable for specific purposes.

Embodiment 1: As shown in FIGS. 1-10, the invention provides the following technical solution: an integrated selective-firing detonator special for oil and gas wells includes an integrated selective-firing detonator body 2. A detonation transmission device 1 is connected to one end of the integrated selective-firing detonator body 2 and used for receiving an external detonation signal and transmitting the external detonation signal to the integrated selective-firing detonator body 2 to control selective firing of perforating bullets. A grounding nut 3 is connected to an end, away from the detonation transmission device 1, of the integrated selective-firing detonator body 2. A positioning disc 4 is mounted on an outer surface of the integrated selective-firing detonator body 2, and a side surface, away from the grounding nut 3, of the positioning disc 4 is fixed to an end of the detonation transmission device 1. A plastic detonating member 5 is mounted on the outer surface of the integrated selective-firing detonator body 2 extending into the detonation transmission device 1.

Wherein, the integrated selective-firing detonator body 2 includes a shell, an outer surface of the shell is connected to an inner surface of the positioning disc 4, a selective-detonation mechanism is mounted on an inner wall of the shell, and a control mechanism is mounted at an end of the selective-detonation mechanism and used for controlling selective firing of the perforating bullets. When the external detonation signal is transmitted to the control mechanism of the integrated selective-firing detonator body 2 by means of the detonation transmission device 1, the control mechanism determines selective firing of the perforating bullets according to the received signal and accurately controls the selective-detonation mechanism to realize accurate selective-firing of the perforating bullets; after a control signal is received, heat will be generated to detonate an explosive; the selective-detonation mechanism is activated, and energy produced by the selective-detonation mechanism is quickly transmitted to the explosive in the shell to trigger the explosive to explode; explosive energy is further transmitted to the perforating bullets by means of the plastic detonating member 5 and the integrated selective-firing detonator body 2 to realize detonation of the perforating bullets; the grounding nut 3 guarantees the electrical safety of a detonator system and is able to quickly guide abnormal current to the ground to prevent equipment from being damaged by the current; and the positioning disc 4 fulfills a fixing and positioning effect to ensure that the detonation transmission device 1 and the integrated selective-firing detonator body 2 are stably connected and will not come loose or be disconnected from each other.

In use, the external detonation signal is transmitted to the control mechanism of the integrated selective-firing detonator body 2 by means of the detonation transmission device 1, and the control mechanism determines selective firing of the perforating bullets according to the received signal and controls the selective-detonation mechanism to realize accurate selective-firing of the perforating bullets; after a control signal is received, heat will be generated to detonate the explosive; the selective-detonation mechanism is activated, and energy produced by the selective-detonation mechanism is quickly transmitted to the explosive in the shell to trigger the explosive to explode; explosive energy is further transmitted to the perforating bullets by means of the plastic detonating member 5 and the integrated selective-firing detonator body 2 to realize detonation of the perforating bullets; and abnormal current are quickly guided to the ground by means of the grounding nut 3 to prevent equipment from being damaged by the current.

Embodiment 2: On the basis of Embodiment 1, referring to FIGS. 2 and 7, the shell includes an upper shell body 21, a lower shell body 22 is detachably mounted on one side of the upper shell body 21, and the upper shell body 21 and the lower shell body 22 are clamped together to form the stable shell, which may withstand a high pressure, a high temperature and other extreme conditions in the blasting process to ensure normal operation of a detonator system. Outer surfaces of the upper shell body 21 and the lower shell body 22 away from the detonation transmission device 1 are in threaded fit with an inner surface of the grounding nut 3, the inner surface of the positioning disc 4 is connected to the outer surfaces of the upper shell body 21 and the lower shell body 22, a bolt is threadedly connected to an outer surface of the positioning disc 4, and ends of the bolt extend into the positioning disc 4 and are in contact with the outer surfaces of the upper shell body 21 and the lower shell body 22 to fasten the upper shell body 21 and the lower shell body 22. The detachable design of the upper shell body 21 and the lower shell body 22 allow related parts to be easily detached and replaced when elements in the shell break down or need to be maintained, thus reducing the maintenance cost and shortening the maintenance time; the upper shell body 21 and the lower shell body 22 are clamped to be preliminarily assembled together to form the enclosed shell, such that the shell may be assembled more easily; the end, away from the detonation transmission device 1, of the shell is adaptively connected to the inner surface of the grounding nut 3 by threads, thus ensuring the electrical grounding safety of the detonator system; moreover, the grounding nut 3 further secures the upper shell body 21 and the lower shell body 22; the positioning disc 4 is mounted outside the upper shell body 21 and the lower shell body 22 to provide stable positioning and support, and the bolt arranged on the outer surface of the positioning disc 4 may be tightened to further fasten the upper shell body 21 and the lower shell body 22 to ensure that the upper shell body 21 and the lower shell body 22 are stably connected and will not come loose.

In operation, the upper shell body 21 and the lower shell body 22 are clamped to be assembled together to form the enclosed shell and are further secured by means of the grounding nut 3, the positioning disc 4 is arranged outside the upper shell body 21 and the lower shell body 22 to provide stable positioning and support, and the bolt on the outer surface of the positioning disc 4 is tightened to further fasten the upper shell body 21 and the lower shell body 22, thus ensuring that the upper shell body 21 and the lower shell body 22 are stably connected and will not come loose.

Embodiment 3: On the basis of Embodiment 1 and Embodiment 2, referring to FIGS. 3-9, the selective-detonation mechanism includes a selective-firing circuit board 25, an outer surface of the selective-firing circuit board 25 is adaptively clamped on inner walls of the upper shell body 21 and the lower shell body 22, a superior contact pin cap 27 is connected to a side, away from the detonation transmission device 1, of the selective-firing circuit board 25, an outer surface of the superior contact pin cap 27 is adaptively clamped on an inner wall of a contact surface between the upper shell body 21 and the lower shell body 22, an internal circlip 26 is arranged on an outer side of the superior contact pin cap 27, a side surface of the internal circlip 26 is connected to end surfaces, away from the detonation transmission device 1, of the upper shell body 21 and the lower shell body 22, an end, close to the detonation transmission device 1, of the selective-firing circuit board 25 extends out of the upper shell body 21 and the lower shell body 22 and fixedly connected to a detonator 23, and an outer surface of the detonator 23 is connected to an inner wall of the plastic detonating member 5. When the external detonation signal is transmitted to the integrated selective-firing detonator body 2 by means of the detonation transmission device 1, the signal is received by the selective-firing circuit board 25 first, and the selective-firing circuit board 25, as a control core, processes the signal and gives a corresponding response.

Figure 10:
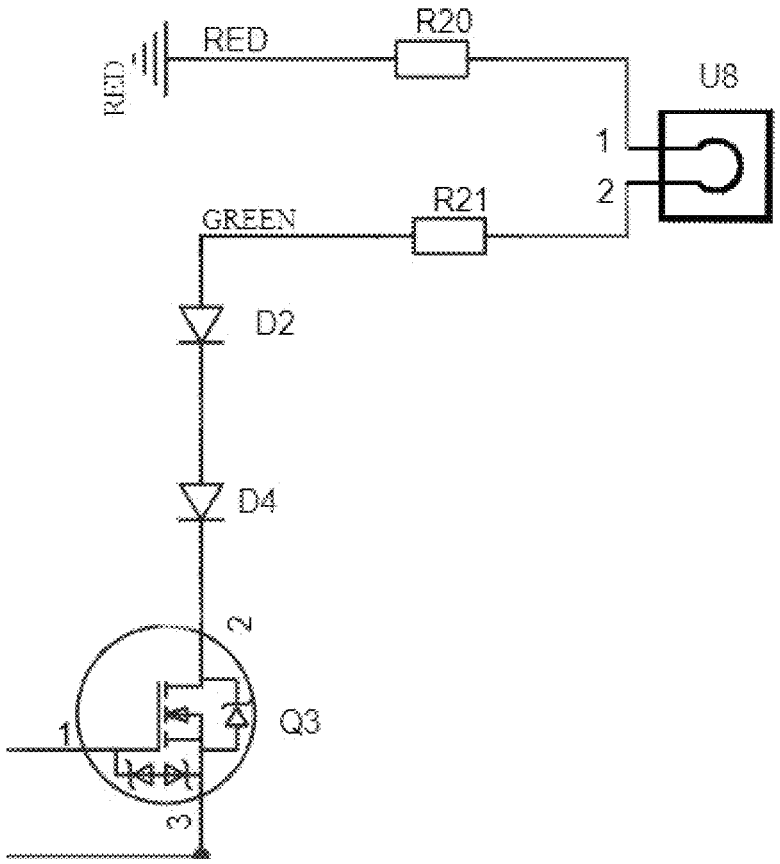
FIG. 10 is a circuit diagram of a selective-firing control circuit according to the invention.

Specifically, referring to FIG. 10, the selective-firing circuit board involved in the invention includes a bridge-wire control circuit. The bridge-wire control circuit is formed by a current-limiting resistor R20, a current-limiting resistor R21, a diode D2, a diode D4, an MOS transistor Q3 and a bridge-wire U8. Wherein, the current-limiting resistor R20 and the current-limiting resistor R21 ensure that stray voltage will not be able to supply energy to the bridge-wire U8 to prevent false triggering; the diode D2 and the diode D4 are used for preventing possible power supply to the bridge-wire U8 caused by erroneous wiring; and the MOS transistor Q3 is controlled by a single chip microcomputer to be turned on and off to satisfy the control requirement for energy supply to the bridge-wire U8. A selective-firing control circuit is arranged on the selective-firing circuit board. The selective-firing control circuit adopts a conventional circuit structure in the art, for example, the selective-firing control circuit includes a power module, a signal receiving module, a detonator driving module, and the like, and each module adopts a conventional circuit structure in the art. It should be emphasized that the selective-firing control circuit and the bridge-wire control circuit in the invention are integrated on the same circuit board, and an electrical interface of the selective-firing control circuit is led out by means of a pogo pin to facilitate connection and operation.

Subordinate conducting pogo pins 24 are fixedly mounted on an outer surface of the selective-firing circuit board 25 close to the detonator 23 and symmetrically arranged with respect to a center line of the selective-firing circuit board 25, ends of the subordinate conducting pogo pins 24 extend out of the upper shell body 21 and the lower shell body 22, outer surfaces of the subordinate conducting pogo pins 24 are connected to the inner walls of the upper shell body 21 and the lower shell body 22, subordinate conducting plates 6 are connected to the ends of the subordinate conducting pogo pins 24, and outer surfaces of the subordinate conducting plates 6 are fixed to the inner wall of the plastic denotating part 5; grounding pogo pins 28 are fixedly mounted on the outer surface of the selective-firing circuit board 25 and symmetrically arranged with respect to the center line of the selective-firing circuit board 25, and ends of the grounding pogo pins 28 are connected to the inner walls of the upper shell body 21 and the lower shell body 22; the control mechanism includes a bridge-wire 29, the bridge-wire 29 is fixedly mounted on an extension plate on sides, close to the detonation transmission device 1, of the subordinate conducting pogo pins 24 and is used for generating heat to trigger an explosion, and the detonator 23 is disposed around the bridge-wire 29; the selective-firing circuit board 25 controls the on-off state of the superior contact pin cap 27 and the subordinate conducting pogo pins 24 by means of an internal circuit according to the received signal, and the subordinate conducting pogo pins 24 are connected to the detonator 23 and the bridge-wire 29 and used for transmitting detonating energy; when the selective-firing circuit board 25 determines that selective firing needs to be performed, the subordinate conducting pogo pins 24 are controlled to enable the bridge-wire 29 to be electrified; after being electrified, the bridge-wire 29 will generate heat quickly, and the heat generated by the bridge-wire 29 triggers an explosive in the detonator 23 to explode; because the bridge-wire 29 is sleeved with the detonator 23, explosive energy will be effectively transmitted into the detonator 23 and then transmitted to the perforating bullets by means of the plastic detonating member 5; and the grounding pogo pins 28 provide an electrical grounding function to ensure that static electricity or abnormal current produced in the operating process of the detonator may be timely guided to the ground to prevent an electrical accident.

In operation, when the external detonation signal is transmitted to the integrated selective-firing detonator body 2 by means of the detonation transmission device 1, the signal is received by the selective-firing circuit board 25 first, the selective-firing circuit board 25, as the control core, processes the signal, gives a corresponding response and controls the on-off state of the superior contact pin cap 27 and the subordinate conducting pogo pins 24 by means of the internal circuit according to the received signal, and the subordinate conducting pogo pins 24 are connected to the detonator 23 and the bridge-wire 29 and used for transmitting detonating energy; when the selective-firing circuit board 25 determines that selective firing needs to be performed, the subordinate conducting pogo pins 24 are controlled to enable the bridge-wire 29 to be electrified; after being electrified, the bridge-wire 29 will generate heat quickly, and the heat generated by the bridge-wire 29 triggers the explosive in the detonator 23 to explode; because the bridge-wire 29 is sleeved with the detonator 23, explosive energy is effectively transmitted into the detonator 23 and then transmitted to the perforating bullets by means of the plastic detonating member 5.

The operating principle of the integrated selective-firing detonator specifical for oil and gas wells is specifically described below.

In use, first, the upper shell body 21 and the lower shell body 22 are clamped to be assembled together to form the enclosed shell and further secured by means of the grounding nut 3, the positioning disc 4 is mounted outside the upper shell body 21 and the lower shell body 22 to provide stable positioning and support, and then the bolt on the outer surface of the positioning disc 4 is tightened to further fasten the upper shell body 21 and the lower shell body 22 to ensure that the upper shell body 21 and the lower shell body 22 are stably connected and will not come loose; then, the integrated selective-firing detonator is deployed; when the external detonation signal is transmitted to the integrated selective-firing detonator body 2 by means of the detonation transmission device 1, the signal is received by the selective-firing circuit board 25 first, and the selective-firing circuit board 25, as the control core, processes the signal, gives a corresponding response and controls the on-off state of the superior contact pin cap 27 and the subordinate conducting pogo pins 24 by means of the internal circuit according to the received signal; the subordinate conducting pogo pins 24 are connected to the detonator 23 and the bridge-wire 29 and used for transmitting detonating energy; when the selective-firing circuit board 25 determines that selective firing needs to be performed, the subordinate conducting pogo pins 24 are controlled to enable the bridge-wire 29 to be electrified; after being electrified, the bridge-wire 29 will generate heat quickly, and the heat generated by the bridge-wire 29 triggers the explosive in the detonator 23 to explode; because the bridge-wire 29 is sleeved with the detonator 23, explosive energy is effectively transmitted into the detonator 23 and then transmitted to the perforating bullets by means of the plastic detonating member 5, such that the perforating bullets are detonated to perform perforation on a hydrocarbon reservoir.

Apparently, the embodiments described above are merely illustrative ones, and are not all possible ones of the invention. All other embodiments obtained by those ordinarily skilled in this or related arts based on the above embodiments without creative labor should also fall within the protection scope of the invention. Structures, devices and operation methods that are not specifically described and explained in the invention should be implemented by conventional means in the art, unless otherwise particularly stated and defined.

What is claimed is:

1. An integrated selective-firing detonator special for oil and gas wells, comprising an integrated selective-firing detonator body (2), a detonation transmission device (1) being connected to an end of the integrated selective-firing detonator body (2) and used for receiving an external detonation signal and transmitting the external detonation signal to the integrated selective-firing detonator body (2) to control selective firing of perforating bullets, a grounding nut (3) being connected to an end, away from the detonation transmission device (1), of the integrated selective-firing detonator body (2), a positioning disc (4) being mounted on an outer surface of the integrated selective-firing detonator body (2), a side surface, away from the grounding nut (3), of the positioning disc (4) being fixed to an end of the detonation transmission device (4), and a plastic denotating member (5) being mounted on the outer surface of the integrated selective-firing detonator body (2) extending into the detonation transmission device (1);

wherein, the integrated selective-firing detonator body (2) comprises a shell, an outer surface of the shell is connected to an inner surface of the positioning disc (4), a selective-detonation mechanism is mounted on an inner wall of the shell, and a control mechanism is mounted at an end of the selective-detonation mechanism and used for controlling selective firing of the perforating bullets;

the shell comprises an upper shell body (21), a lower shell body (22) is detachably mounted on a side of the upper shell body (21), the upper shell body (21) and the lower shell body (22) are clamped together, and outer surfaces of the upper shell body (21) and the lower shell body (22) away from the detonation transmission device (1) are in threaded fit with an inner surface of the grounding nut (3);

the selective-detonation mechanism comprises a selective-firing circuit board (25), an outer surface of the selective-firing circuit board (25) is adaptively clamped on inner walls of the upper shell body (21) and the lower shell body (22), a superior contact pin cap (27) is connected to a side, away from the detonation transmission device (1), of the selective-firing circuit board (25), an outer surface of the superior contact pin cap (27) is adaptively clamped on an inner wall of a contact surface between the upper shell body (21) and the lower shell body (22), an internal circlip (26) is arranged on an outer side of the superior contact pin cap (27), and a side surface of the internal circlip (26) is connected to end surfaces, away from the detonation transmission device (1), of the upper shell body (21) and the lower shell body (22);

an end, close to the detonation transmission device (1), of the selective-firing circuit board (25) extends out of the upper shell body (21) and the lower shell body (22) and fixedly connected to a detonator (23), and an outer surface of the detonator (23) is connected to an inner wall of the plastic detonating member (5);

subordinate conducting pogo pins (24) are fixedly mounted on the outer surface of the selective-firing circuit board (25) close to the detonator (23) and symmetrically arranged with respect to a center line of the selective-firing circuit board (25), ends of the subordinate conducting pogo pins (24) extend out of the upper shell body (21) and the lower shell body (22), outer surfaces of the subordinate conducting pogo pins (24) are connected to the inner walls of the upper shell body (21) and the lower shell body (22), subordinate conducting plates (6) are connected to the ends of the subordinate conducting pogo pins (24), and outer surfaces of the subordinate conducting plates (6) are fixed to the inner wall of the plastic detonating member (5);

the inner surface of the positioning disc (4) is connected to the outer surfaces of the upper shell body (21) and the lower shell body (22), a bolt is threadedly connected to an outer surface of the positioning disc (4), and ends of the bolt extend into the positioning disc (4) and are in contact with the outer surfaces of the upper shell body (21) and the lower shell body (22) to fasten the upper shell body (21) and the lower shell body (22);

grounding pogo pins (28) are fixedly mounted on the outer surface of the selective-firing circuit board (25) and symmetrically arranged with respect to the center line of the selective-firing circuit board (25), and ends of the grounding pogo pins (28) are connected to the inner walls of the upper shell body (21) and the lower shell body (22);

the control mechanism comprises a bridge-wire (29), the bridge-wire (29) is fixedly mounted on an extension plate on sides, close to the detonation transmission device (1), of the subordinate conducting pogo pins (24) and used for generating heat to trigger an explosion, and the detonator (23) is disposed around the bridge-wire (29).

* * * * *